US005114166A

United States Patent [19]

McCosker

[11] Patent Number: 5,114,166

[45] Date of Patent: May 19, 1992

[54] WHEELED COASTING BOARD

[76] Inventor: Robert E. McCosker, 24232 Tahoe Ct., Laguna Niguel, Calif. 92677

[21] Appl. No.: 497,887

[22] Filed: Mar. 23, 1990

[51] Int. Cl.[5] ..... A63C 17/02

[52] U.S. Cl. ..... 280/87.042; 280/11.28; 301/5.7; 301/36 R; 301/63 PW

[58] Field of Search ..... 280/87.041, 87.042, 280/87.021, 87.01, 11.28; D21/227; 301/5 R, 5.3, 5.7, 13 SM, 36 R, 63 PW; 152/5

[56] References Cited

U.S. PATENT DOCUMENTS

| | | | |
|---|---|---|---|
| 657,790 | 9/1900 | Ross | 301/5.3 |
| 1,603,529 | 10/1926 | Faust | 280/11.28 |
| 1,823,526 | 9/1931 | Breeden | 280/32.6 |
| 2,408,617 | 10/1946 | Ferrar | 280/11.19 |
| 2,422,228 | 6/1947 | Ferrar | 280/11.19 |
| 2,537,213 | 1/1951 | De Vault | 280/11.28 |
| 2,632,652 | 3/1953 | Wintercorn | 280/11.28 |
| 4,202,558 | 5/1980 | Olschewski et al. | 280/87.042 |

*Primary Examiner*—Andres Kashnikow
*Assistant Examiner*—Eric Culbreth
*Attorney, Agent, or Firm*—Edgar W. Averill, Jr.

[57] ABSTRACT

A wheeled board for riding downhill over the ground. The board has a generally flat riding board which is supported by four wheels through carriage assemblies. The carriage assemblies are held to the board through springs and supported so that when the board is tilted to the right, the front axle will turn in a clockwise manner, and the rear axle will turn in a counter-clockwise manner as viewed from above thereby causing the board to turn to the right. Conversely, when the board is tilted to the left, the front axle will turn counter-clockwise and the rear axle will turn clockwise causing the board to turn to the left. The wheels of the board have a diameter of between four and eight inches and a width of between three and nine inches.

10 Claims, 2 Drawing Sheets

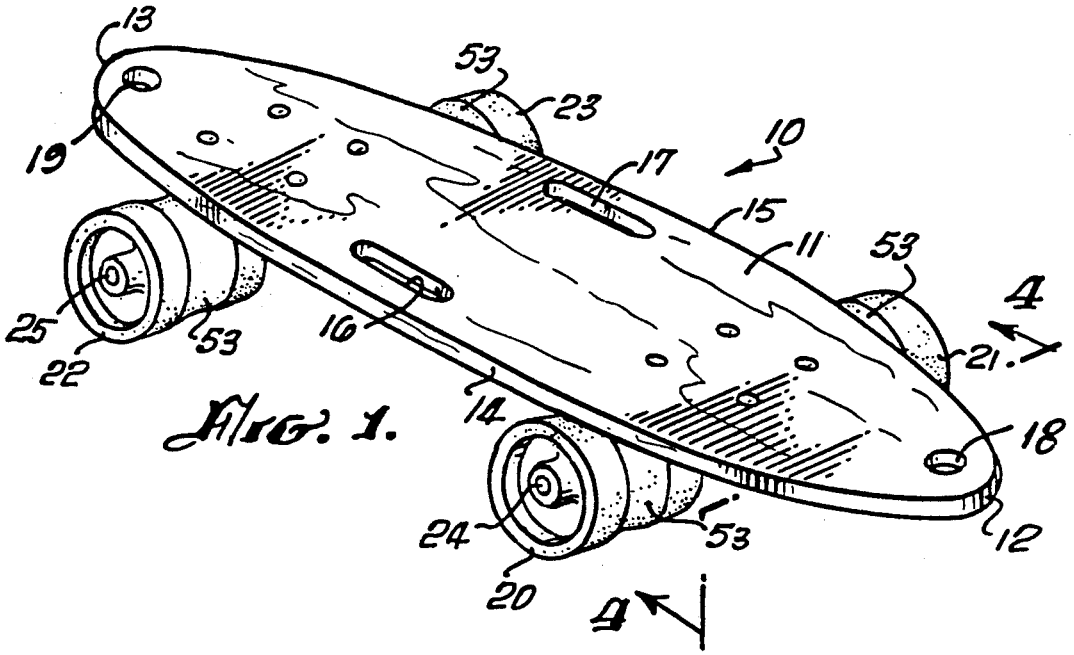
FIG. 1.
FIG. 2.
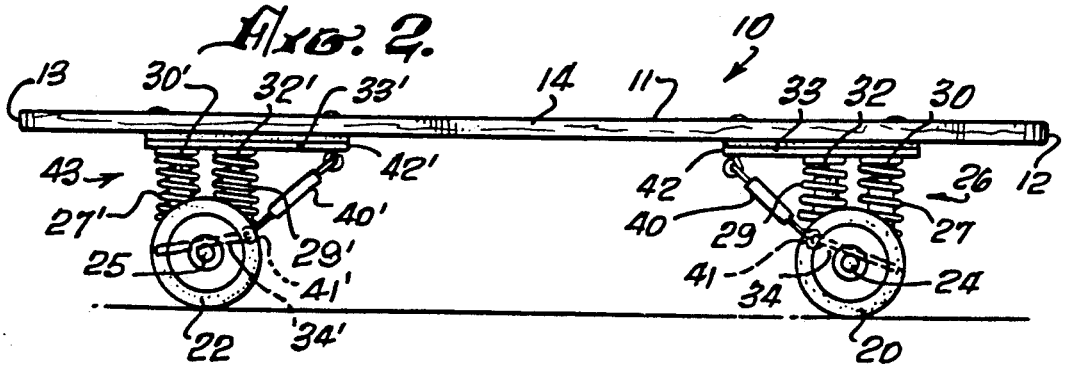
FIG. 3.
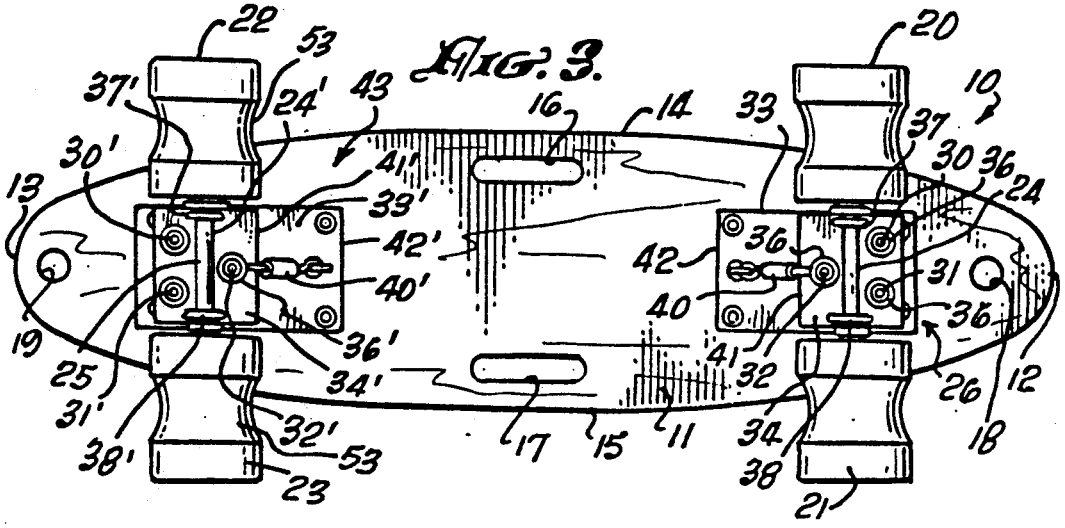

FIG. 4.
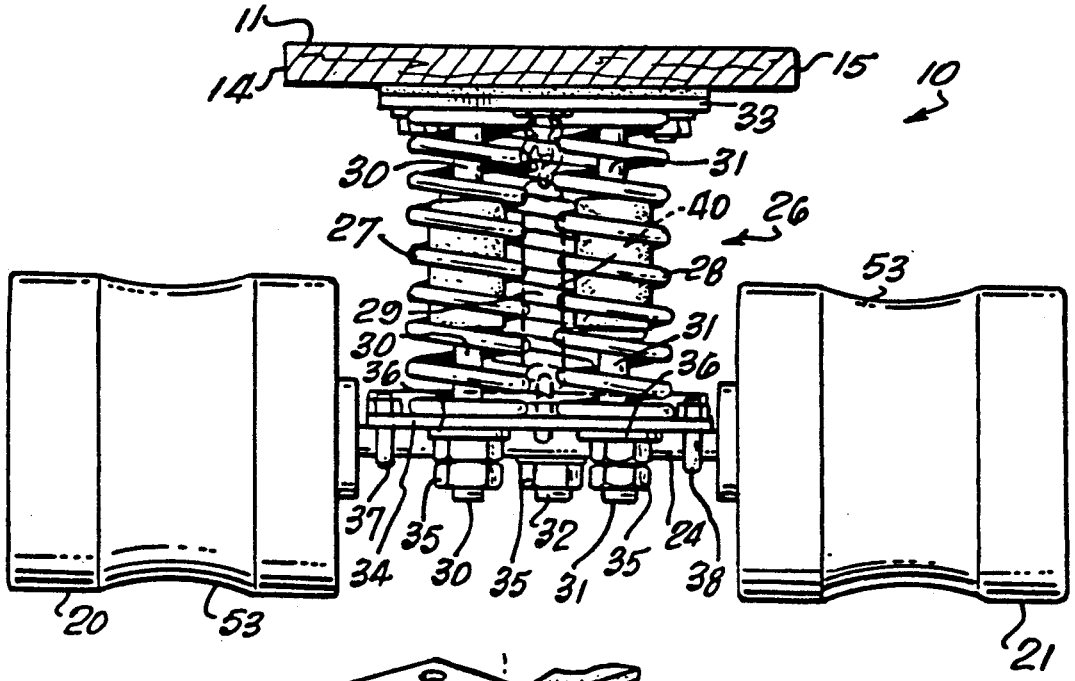
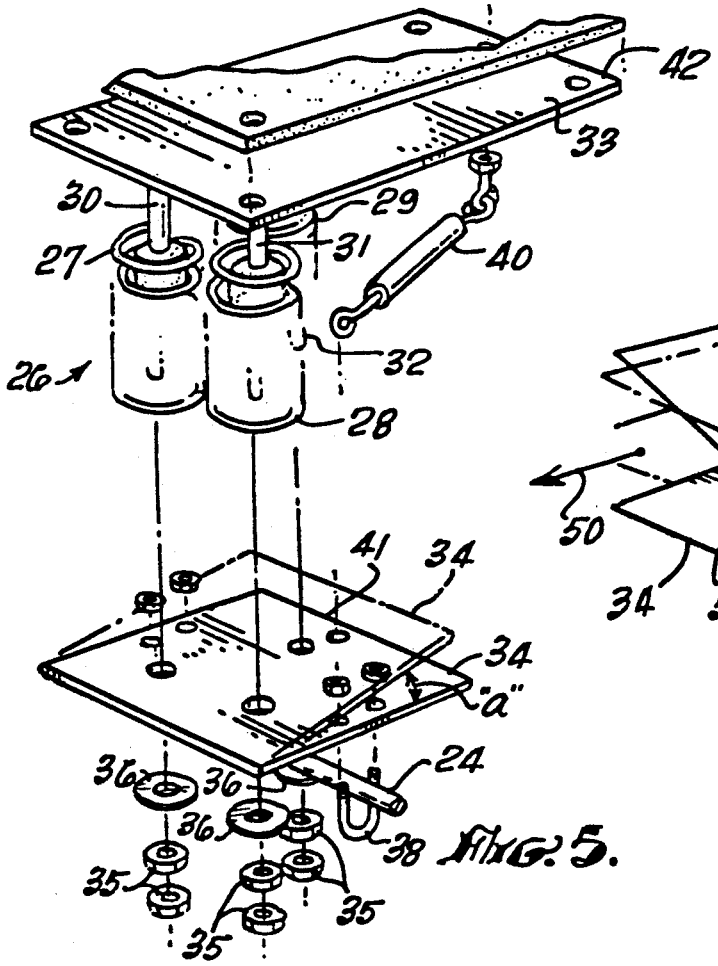
FIG. 5.
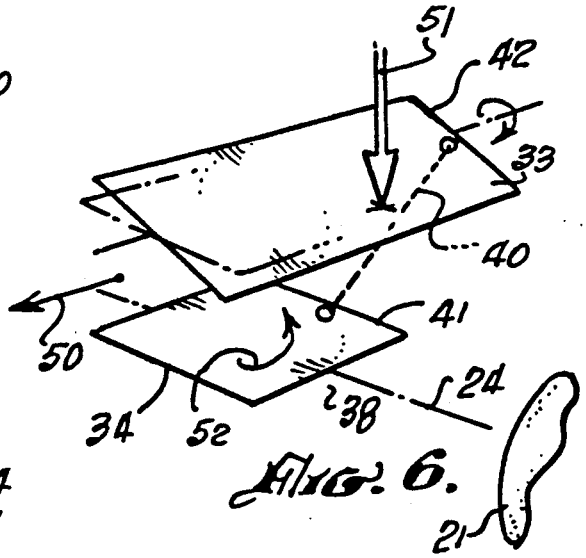
FIG. 6.

WHEELED COASTING BOARD

BACKGROUND OF THE INVENTION

The field of the invention is sporting goods, and the invention relates more particularly to riding boards of the same general category as skate boards.

Skate boards have found wide acceptance for riding on smooth, hard surfaces such as cement, asphalt, wood or the like. Such boards are not, however, satisfactory for use over turf or uneven dirt. There are many grassy hills and ski slopes which are not usable for skate boards, but which would provide amusement for riders and income for ski lift operators if a board could be devised which could be ridden on turf or dirt.

SUMMARY OF THE INVENTION

It is an object of the present invention to provide a wheeled board for riding downhill over the ground.

The present invention is for a wheeled board having a generally flat riding board with a front carriage assembly affixed to the lower surface thereof. The front carriage assembly is supported by an upper plate which, in turn, supports a front axle through biasing and support means comprising three discreet spring means which permits the front axle to move upwardly providing a spring compensated ride over rough terrain and also supported so that when the board is tilted to the right, the front axle will turn in a clockwise direction, and the rear axle will turn in a counter-clockwise direction. Similarly, the rear carriage assembly is supported by an upper plate which supports the rear axle through biasing and support means comprising three discreet spring means. Preferably, the biasing and support means comprises coiled springs which each surround a support rod. Preferably, each carriage has two outer springs and one inner spring, and a support length is affixed between the lower surface of each spring and support rod and the upper plate. The wheels have a diameter of between four and eight inches and a width of between three and nine inches and, preferably, have a shallow groove in the center thereof. Preferably, each carriage has a lower plate which is tilted toward the longitudinal center of the board by a support length affixed between the inner edge of the lower plate and the inner edge of each upper plate.

BRIEF DESCRIPTION OF THE DRAWINGS

FIG. 1 is a perspective view of the wheeled board of the present invention.

FIG. 2 is a side view thereof.

FIG. 3 is a bottom view thereof.

FIG. 4 is an enlarged cross-sectional view taken along line 4—4 of FIG. 1.

FIG. 5 is an exploded perspective view of the front carriage assembly of the wheeled board of FIG. 1.

FIG. 6 is a diagrammatical view showing the turning of the front axle with a tilt of the riding board.

DESCRIPTION OF THE PREFERRED EMBODIMENTS

The wheeled board of the present invention is shown in perspective view in FIG. 1 and indicated by reference character 10. Wheeled board 10 has a generally flat riding board 11 with a front 12, a rear 13, an elongated right side 14 and an elongated left side 15. A right carrying handle 16 and a left carrying handle 17 facilitate the carrying of the wheeled board, and a front towing opening and a rear towing opening facilitate the carry of the board either by towing it or hanging it on a hook.

Wheeled board 10 has four wide wheels, namely, right front wheel 20, left front wheel 21, right rear wheel 22 and left rear wheel 23. The front wheels are supported on a front axle 24 and the rear wheels are supported on a rear axle 25.

As shown in FIG. 2, front axle 24 is supported by a front carriage assembly 26 comprising two front coiled springs, the right front spring being indicated by reference character 27 and the left front spring by reference character 28. A single inner coil spring 29 completes the biased support of the front carriage assembly. Outer right spring 27 has a support rod 30. An outer left spring has a support rod 31. The single inner coil spring 29 has a support rod 32. Each of these support rods is held by a front upper plate 33 at their upper ends and by a front lower plate 34 at their lower ends. As show best in FIG. 4, the support rods are held by a pair of nuts 35 over washers 36, and the three openings in front lower plate 34 are sufficiently large so that the support rods 30, 31 and 32 can pass through them permitting the board to flex with respect to the lower plate and the axle which is supported thereby. The front axle 24 is held to lower plate 34 by U bolts 37 and nuts 38. Of course, in production, the lower plate 34 would undoubtedly be formed integrally with axle 24. Front lower plate 34 is maintained at an angle of between 0° and 45° and preferably about 10° with respect to the board surface by a link 40 affixed between the inner edge 41 of lower plate 34 to near the inner edge 42 of upper plate 33. The rear carriage assembly 43 has been given the same reference characters as the front carriage assembly except with a prime after each reference character and operates in an identical manner. It should be pointed out, however, because the rear carriage assembly has been turned 180° with respect to the front carriage assembly, that the axle turns in the opposite direction as the board is tilted. As evident from FIGS. 2, 4 and 5, the weight of the riding board 11 and any user thereon is supported largely by the springs.

The turning action of the axle with respect to the tilt of the board is illustrated best in FIG. 6 where the direction of travel is indicated by reference character 50, and the carriage assembly, shown in FIG. 6, is the front carriage assembly. As the upper plate 33 tilts to the left with pressure to the left indicated by arrow 51, the front axle turns counter-clockwise as indicated by arrow 52 as viewed from the top of the board. This, of course, causes the board to turn to the left. At the same time, it is evident that the rear upper plate 33', when tilted to the left causes the rear axle 25 to turn clockwise as viewed from above. The combined effect is, of course, to turn the board to the left when tilted to the left. Conversely, the board will be turned to the right by the clockwise turning of the front axle and the counter-clockwise turning of the rear axle when the board is tilted to the right.

The wheels of wheel board 10 form an important part of the present invention. They should have an outside diameter of between four and eight inches and should be between three and nine inches wide. In this way, they will be able to go over the normal depressions found in turf or relatively hard dirt without causing a sudden stopping of the board. The wheels can be molded from a relatively rigid polymer such as a urethane polymer or from a slightly more rigid polymer such as acrylonitrile butadiene styrene terpolymer. The wheels, of course, should have excellent impact resistance as they can be subjected to substantial impact in use.

The wheeled board of the present invention can be used very advantageously on ski slopes in the summer and provide a controlled and yet exciting ride. The wheels preferably have a shallow groove 53 in the center thereof to provide a certain amount of lateral stability.

While coiled springs have been shown as providing flexibility between the axle assembly and the board, other biasing means can be used. These would include leaf springs or rubber springs. It is only important that a substantial movement of up to one inch be provided in use so that the wheels can compensate for bumps in the ride.

In the claims, the word "inner" and "outer" as used to define particular springs means that the "inner" spring is closer to the middle of the board than the axle with which it is associated, and the "outer" springs are outside of or nearer the outer edge of the board than the axle with which they are associated. Thus, as shown in FIG. 5, spring 29 would be an inner spring, and springs 27 and 28 would be outer springs.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A wheeled board for riding downhill over the ground, said board comprising:

a generally flat riding board having an upper riding surface and a lower carriage surface, a front, a back and elongated right and left sides;

a front carriage assembly having a front upper plate affixed to the lower carriage surface near the front of said riding board, said front carriage assembly including a front axle supported by said front upper plate through biasing and support means comprising three discreet spring means which directly and largely support the front upper plate and which permit the front axle to move upwardly toward the riding board under load, and said biasing and support means being affixed between said front axle and said front upper plate so that the axle will turn clockwise as viewed from above when the board is tilted to the right and counterclockwise when the board is tilted to the left;

a rear carriage assembly having a rear upper plate affixed to the lower carriage surface near the rear of said riding board, said rear carriage assembly including a rear axle supported by said rear upper plate through biasing and support means comprising three discreet spring means which directly and largely support the rear upper plate which permit the rear axle to move upwardly toward the riding board under load, and said biasing and support means being affixed between said rear axle and said rear upper plate sot hat the axle will turn counterclockwise as viewed from above when the board is tilted to the right and clockwise when the board is tilted to the left;

wherein each of said front and biasing and support means comprises a single inner coiled spring surrounding a support rod and a pair of outer coiled springs, each surrounding a support rod, and the support rods being affixed three to the front upper plate and three to the rear upper plate, and the front support rods being affixed to the front axle at their lower ends, and the rear support rods being affixed to the rear axle at their lower ends, and wherein the front support rods are affixed to the front axle through a lower plate, and said lower plate is held to the front upper plate through both the three support rods and by a support link affixed at the center of the inner edge of the upper and lower plates; and a right and a left front wheel and a right and a left rear wheel, each wheel being rotatably affixed to an axle, each of said wheels having a diameter of between four and eight inches and a width of between and three and nine inches.

2. The wheeled board of claim 1 wherein the rear support rods are affixed to the rear axle through a lower plate, and said lower plate is held to the rear upper plate through both the three support rods and by a support link affixed at the center of the inner edge of the upper and lower plates.

3. The wheeled board of claim 1 wherein the rear support rods are affixed to the rear axle through a lower plate, and said lower plate is held to the rear upper plate through both the three support rods and by a support link affixed at the center of the inner edge of the upper and lower plates.

4. The wheeled board of claim 3 wherein the lower plates are angled toward the center of the board an angle of between 0° and 45° with respect to the lower carriage surface of the board.

5. The wheeled board of claim 1 wherein the riding board includes a carrying handle near at least one edge of the board near the longitudinal center thereof.

6. The wheeled board of claim 5 wherein the riding board has two carrying handles.

7. The wheeled board of claim 1 wherein each of said wheels has a central shallow groove extending over about half of the wheel.

8. A wheeled board for riding downhill over the ground, said board comprising:

a generally flat riding board having an upper riding surface and a lower carriage surface, a front, a back and elongated right and left sides;

a front carriage assembly having a front upper plate affixed to the lower carriage surface near the front of said riding board, said front carriage assembly including a front axle supported by a front lower plate which is supported to said front upper plate through two outer coiled springs each surrounding a support rod and an inner coil spring surrounding a support rod which permits the front axle to move upwardly toward the riding board under load, and said lower plate being held at an angle of about 10° with respect to the board surface toward the longitudinal center of the board and said coil springs and support rods being affixed between said front axle and said front upper plate so that the axle will turn clockwise as viewed from above when the board is tilted to the right and counter-clockwise when the board is tilted to the left;

a rear carriage assembly having a rear upper plate affixed to the lower carriage surface near the rear of said riding board, said rear carriage assembly including a rear axle supported by a rear lower plate which is supported to said rear upper plate through two outer coiled springs each surrounding a support rod and an inner coil spring surrounding a support rod which permits the rear axle to move upwardly toward the riding board under load, and said lower plate being held at an angle of about 10° with respect to the board surface toward the longitudinal center of the board and said springs and support rods being affixed between said rear axle and said rear upper plate so that the axle will turn counter-clockwise as viewed from above when the board is tilted to the right and clockwise when the board is tilted to the left;

a right and a left front wheel and a right and a left rear wheel, each wheel being rotatably affixed to an axle, each of said wheels having a diameter of between four and eight inches and a width of between and three and nine inches; and at least one carrying handle located near the longitudinal center of one of the edges.

9. The wheeled board of claim 8 wherein said riding board has a pair of carrying handles.

10. The wheeled board of claim 9 wherein said right and left front and rear wheels have a central shallow groove covering about half of the width of each wheel.

* * * * *